United States Patent [19]

Hayashi et al.

[11] 4,051,303

[45] Sept. 27, 1977

[54] RECORDING SHEET

[75] Inventors: Takao Hayashi; Hajime Kato, both of Fujinomiya, Japan

[73] Assignee: Fuji Photo Film Co., Ltd., Minami-ashigara, Japan

[21] Appl. No.: 596,798

[22] Filed: July 17, 1975

Related U.S. Application Data

[63] Continuation of Ser. No. 387,228, Aug. 9, 1973, abandoned.

[30] Foreign Application Priority Data

Aug. 15, 1972 Japan ..... 47-81681

[51] Int. Cl.[2] ..... B41M 5/22

[52] U.S. Cl. ..... 428/411; 282/27.5; 427/150; 427/151; 428/913; 428/914

[58] Field of Search ..... 427/145, 146, 150, 151; 428/411, 913, 914, 537; 282/27.5

[56] References Cited

U.S. PATENT DOCUMENTS

| | | | |
|---|---|---|---|
| 3,703,398 | 11/1972 | Ono et al. | 428/307 |
| 3,732,120 | 5/1973 | Brockett et al. | 428/307 |
| 3,767,449 | 10/1973 | Hayashi et al. | 428/323 |
| 3,772,052 | 11/1973 | Kimura et al. | 428/341 |
| 3,864,146 | 2/1975 | Oda et al. | 117/36.8 |
| 3,896,255 | 7/1975 | Kato et al. | 427/145 |

*Primary Examiner*—Thomas J. Herbert, Jr.
*Assistant Examiner*—Bruce H. Hess
*Attorney, Agent, or Firm*—Sughrue, Rothwell, Mion, Zinn and Macpeak

[57] ABSTRACT

A recording sheet comprising a support having thereon a color developer layer containing (1) a metal compound of an aromatic carboxylic acid and (2) at least one of gelatin or a gelatin derivative, the metal compound of an aromatic carboxylic acid being capable of forming a colored image when reacted with a color former.

14 Claims, No Drawings

RECORDING SHEET

This is a continuation of application Ser. No. 387,228, filed Aug. 9, 1973, now abandoned.

BACKGROUND OF THE INVENTION

1. Field of the Invention

This invention relates to a recording sheet. More particularly, it relates to a recording sheet utilizing an improved color developer.

2. Description of the Prior Art

Recording sheets in which the coloring reaction of an substantially colorless electron donating organic compound (hereinafter, designated "color former"), for example, such as Malachite Green Lactone, Benzoyl Leuco Methylene Blue, Crystal Violet Lactone, 3-Dialkylamino-7-dialkylaminofluoran and 3-Methyl-2,2'-spirobi(benzo(f)chromene), with an electron accepting adsorptive or reactive compound, which develops color in contact with the color former (hereinafter, designated "color developer"), is used.

As recording sheets in which the above phenomenon is utilized practically, there can be mentioned a pressure sensitive copying paper (for example, see U.S. Pat. Nos. 2,505,470; 2,505,489; 2,550,471; 2,548,366; 2,712,507; 2,730,456; 2,730,457; and 3,418,250 etc.) and a heat sensitive copying paper (for example, see Japanese Patent Publication No. 4160/68, U.S. Pat. No. 2,939,009 etc.). Further, a printing method is known in which an ink containing a color former is applied to a sheet coated with a color developer through a medium such as a stencil to form a colored image (see German Laid-open Specification No. 1,939,962 etc.).

In many cases the coloring reaction of the color former requires pressure from a ball point pen or typewriter, heat or other physical conditions.

One typical embodiment of such a recording sheet is a pressure sensitive copying paper. The pressure sensitive copying paper is obtained by dissolving a color former in a solvent such as chlorinated paraffin, alkyl naphthalene, alkylated diphenylethane alkylated diphenylmethane and alkylated diphenyl, dispersing the solution in a binder or encapsulating it in microcapsules, and coating the dispersion or microcapsules on a support such as paper, plastic film and resin-coated paper.

A heat sensitive copying paper is obtained by coating a color former together with a heat-fusible substance such as acetanilide on a support. In this case, the term "heat-fusible substance" means a substance which is fused on heating and dissolves the color former. A color developer may be coated or impregnated as an ink. In general, a color former and a color developer each is coated on the same surface or opposite surfaces of a support or on different supports respectively.

As color developers, in general acid materials, for example, clays such as Japanese acid clay, activated clay, atapulgite, zeolite and bentonite, organic acids such as succinic acid, tannic acid, gallic acid and phenol compounds, and acid polymers such as phenol resins are suitable.

We, the inventors, have proposed previously that a metal compound of an aromatic carboxylic acid was effective as a color developer for a recording sheet. That is, the performance of a color developer was found to be improved substantially by using a metal compound of an aromatic carboxylic acid. However, the color developing capacity and film surface strength of the coated layer were not satisfactory depending on the preparation of color developer coating solution, thus still leaving room for improvement.

SUMMARY OF THE INVENTION

Accordingly, an object of this invention is to provide a recording sheet having improved color development capability.

Another object of this invention is to improve the coatability of a coating solution for the manufacture of a recording sheet having improved color development power.

We have observed that when a coating solution containing a metal compound of an aromatic carboxylic acid was prepared, not only the viscosity of coating solution was increased but also that aggregates of the metal compound were formed, so that the color developing capability of the final color developer layer was insufficient, and thus we reached this invention.

That is, the above objects of this invention can be attained by incorporating gelatin or gelatin derivatives into the color developer coating solution containing the metal compounds of aromatic carboxylic acid.

DETAILED DESCRIPTION OF THE INVENTION

While the metal compound of aromatic carboxylic acid can be used as a color developing component alone because it, per se, has color development capability, it can be used together with other color developers where desired.

The term "gelatin", as used in this invention, is employed in its generally known meaning as describing, the protein derived from collagen, for example, lime- or acid-treated gelatin; the term gelatin derivative is used to describe the reaction product of gelatin and an aromatic or an aliphatic compound having groups capable of reacting with gelatin.

The action of gelatin or gelatin derivatives according to this invention differs depending on the physical properties of the gelatin or the gelatin derivative. Namely, according to our research, it was found that the lower the jelly strength, which in general describes the property of gelatin or its derivatives, is, the greater the color developing capability increases and the viscosity of coating solution on aging decreases, resulting in a particularly large advantage for this invention. Accordingly, a smaller jelly strength of the gelatin or the gelatin derivatives is preferred and a particularly preferred jelly strength is a jelly strength of less than 150. However, this jelly strength is only a preferred embodiment and advantage, although not as great, can be obtained with a jelly strength higher than 150. Typically a jelly strength of 10 to 150 is suitable.

Examples of aromatic or aliphatic compounds, which react with gelatin and form gelatin derivatives, are acid anhydrides (for example, phthalic, benzoic, trimellitic, pyromellitic, sulfophthalic, maleic, succinic, acetic acid anhydride), compounds having a reactive halogen atom (for example, compounds having a sulfonylchloride group such as benzenesulfonylchloride, p-methoxybenzenesulfonylchloride, p-phenoxybenzenesulfonylchloride, p-chlorobenzenesulfonylchloride, p-bromobenzenesulfonylchloride, p-toluenesulfonylchloride, m-nitrobenzenesulfonylchloride, m-chlorosulfonylbenzoyl chloride, m-carboxyl benzenesulfonylchloride, m-carboxy-p-bromobenzenesulfonylchloride, β-naphthalenesulfonylchloride, 4-phenyl-5-(p-chlorosulfonylphenyl)-2-imidazolone; compounds having fluorosulfonyl group such as p-aminobenzenesulfonylfluoride, m-aminobenzenesulfonylfluoride, m-, p-diaminobenzenesulfonylfluoride, p-toluenesulfonylfluoride, m-fluorosulfonyl benzoic acid, 2-hydroxy-5-fluorosulfonyl benzoic acid, m-fluorosulfonylbenzoylacetamide; compounds having an acylchloride or acylbromide group such as phthaloylchloride, benzoyl chloride, p-nitrobenzoyl chloride, p-carboxybenzoyl chloride; compounds having a free halogen atom such as p-bromomethyl benzoic acid, n-acylchloroformate, benzylchloroformate, methoxyethylchloroformate, methoxypropylchloroformate, phenoxyethylchloroformate, cyclohexylchloroformate, cyclopentylchloroformate, mucochloric acid, 1,3,5-tri-(bromoacetyl)-perhydro-1,3,5-triazine and the potassium salt of 4-fluoro-3-nitrobenzene sulfonic acid; isocyanates (for example, phenyl isocyanate, p-tolyl isocyanate, p-bromophenyl isocyanate, p-chlorophenyl isocyanate) and N-allyl-N-vinyl sulfonamides (for example, N-vinyl sulfonic acid p-phenetidide, N-vinyl sulfonic acid-p-toluidide, N-vinyl sulfonic acid-N-methylanilide).

The amount of gelatin or gelatin derivatives used in this invention is preferably from 10 to 100 parts by weight per 100 parts by weight of the aromatic carboxylic acid used. However, these ratios are not limiting and ratios outside of the above set forth range can be used to improve the color developing capability and the stability of viscosity with the passage of time for the purpose of this invention. Namely, on adding more than 100 parts by weight of gelatin or a gelatin derivative per 100 parts by weight of said aromatic carboxylic acid, the viscosity of the coating solution with the passage of time is lowered with a small additional increase in color developing capability. On the other hand, on adding less than 10 parts by weight of gelatin or the gelatin derivatives, both the color developing capability and aging viscosity are improved but to an insufficient extent to obtain a satisfactory result.

The term "metal compound of aromatic carboxylic acid" is intended to cover the reaction product of the alkali metal salt of an aromatic carboxylic acid and a water soluble metal salt in a solent, in which both reaction components are soluble. In this case, the alkali metal salt and the water soluble metal salt may be reacted in any desired ratio but desirably, it is preferred to react them in the equal gram equivalents.

The aromatic carboxylic acid is preferably represented by the formula:

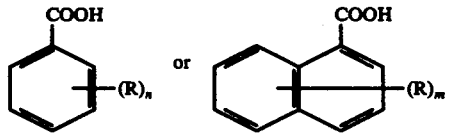

wherein R may be the same or different and represents a hydrogen atom, a hydroxy group, a halogen atom such a chlorine, a nitro group, an alkyl group having 1 to 10 carbon atoms (preferably 3 to 6 carbon atoms), of which the total carbon atoms are less than 13, an aryl group such as phenyl group, an arylamino group such as anilino group, and an alicyclic group such as hexyl group, *m* is an integer of 0 to 7 and *n* is an integer of 0 to 5, and the aromatic carboxylic acid may be dimerized through the substituent R as a methylene group.

More preferable compounds are those represented by the formula,

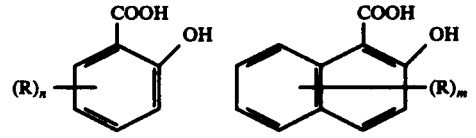

wherein R, *m* and *n* are as defined above.

The most preferable compounds are those represented by for formula,

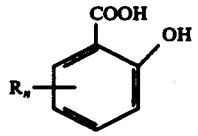

wherein R is as defined above, *n* is 1 or 2, and R is attached to the meta-position relative to the hydroxy group.

Above all, aromatic carboxylic acids having at least one hydroxyl group are especially effective and those having a hydroxyl group in the o-position, i.e., the aromatic carboxylic acids represented by the following formulae, are more effective.

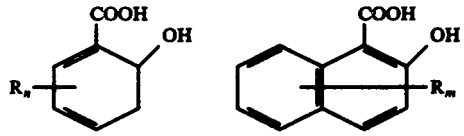

wherein R, *m* and *n* are as defined above.

Examples of aromatic carboxylic acids which can be used in this invention are: benzoic acid, chlorobenzoic acid (o-, m- and p-), toluic acid (o-, m- and p-), 2-chloro-4-nitrobenzoic acid, 2,3-dichlorobenzoic acid, p-isopropyl benzoic acid, 2,4-dihydroxybenzoic acid, 2,5-dihydroxybenzoic acid, 1-naphthoic acid, 1-hydroxy-2-naphthoic acid, 2-hydroxy-3-naphthoic acid, 2-hydroxy-1-naphthoic acid, salicylic acid, 3,5-dinitrosalicylic acid, 3-methylsalicylic acid, 2,4-cresotic acid, 2,5-cresotic acid, 5-tert-butyl salicylic acid, 3-phenyl salicylic acid, 3-methyl-5-tert-butyl salicylic acid, 3,5-di-tert-butyl salicylic acid, 3,5-di-tert-amyl salicylic acid, 3-cyclohexyl salicylic acid, 5-cyclohexyl salicylic acid, 3-methyl-5-isoamyl salicylic acid, 5-isoamyl salicylic acid, 5-nonyl salicylic acid, 3,5-di-sec-butyl salicylic acid and the like.

Those metal salts which can be used for manufacturing the metal compound of the aromatic carboxylic acid are the metal chlorides, sulfates, nitrates, acetates, etc. As the metals which form the metal compound of the aromatic carboxylic acid used in this invention, there can be mentioned metals of Group IB of the Periodic Table as, e.g., copper and silver; metals of Group II A as, e.g., magnesium and calcium; metals of Group II B, e.g., zinc, cadmium and mercury; metals of Group III B, e.g., aluminum and gallium; metals of Group IV A, e.g., tin and lead; metals of Group VI A, e.g., chromium and molybdenum; metals of Group VII B, e.g., manganese; and metals of Group VIII such as cobalt and nickel. Among these metals, zinc, tin, aluminum and nickel are especially effective.

Various methods can be used to manufacture the color developer according to this invention and provide the color developer on a supporter, and the method for manufacturing the color developer is not critical because the effect of this invention results from the simple combination together of at least one of the metal compounds of an aromatic carboxylic acid and at least one of gelatin and or a gelatin derivative. However, as the second object of this invention in order to simplify the preparation of the coating solution containing the alkali metal salt of an aromatic carboxylic acid, it is desirable to add at least one of the gelatin and the gelatin derivative before the reaction of the alkali metal salt of the aromatic carboxylic acid and the water soluble metal salt.

The color developer layer according to this invention can contain acid resins such as phenol-formaldehyde resins or metal oxides and hydroxides, clays or the chemically or physically treated products thereof without any loss in the effect according to this invention. For example, to the coating solution, there may be added acid resins such as phenol-formaldehyde resin such as p-phenylphenol-formaldehyde resin, p-t-butylphenol-formaldehyde resin, p-chlorophenol-formaldehyde resin, other color developers such as Japanese acid clay and active clay, attapulgite, inorganic pigments such as metal oxides and metal, (such as Zn, Mg and Al) hydroxides or chemically or physically treated-products thereof as disclosed in U.S. Pat. Nos. 3,672,930 and 3,732,120.

The coating solution of color developer according to this invention contains at least one of a metal compound of an aromatic carboxylic acid and at least one of gelatin or a gelatin derivative as necessary components and, if desired, binders such as latexes such as styrene-butadiene copolymer latex, acrylic acid ester copolymer latex, vinyl acetate polymer latex, vinyl acetate-acrylic acid ester copolymer latex, butyl polymer latex, butadiene polymer latex, styrene-acrylic acid ester copolymer latex, butadiene-acrylic acid ester copolymer latex, natural rubber latex, etc.; water soluble high molecular substances such as polyvinyl alcohol, starch, gum arabic, casein, sodium alginate, carboxy methyl cellulose, sodium acrylate polymer, water soluble phenol resins, the sodium salt of styrene-maleic anhydride copolymer, methyl cellulose, hydroxyethyl cellulose and the like can be employed. It is to be understood that all binders well-known as film-forming materials can be used in the invention. The binders can be classified into three groups, i.e., (1) a water soluble or hydrophilic binder, for example, a natural compound such as proteins (e.g., gelatin, gum arabic, colloid albumin, casein), celluloses (e.g., carboxymethyl cellulose, hydroxyethyl cellulose), saccharoses (e.g., agar, sodium alginate, starch, carboxymethyl starch), and a synthetic compound such as polyvinyl alcohol, poly-N-vinylpyrrolidone, polyacrylate, polyacrylamide; (2) a water-dispersible binder, for example, latex such as styrenebutadiene copolymer latex, styrene-maleic anhydride copolymer latex; and (3) an organic solvent-soluble binder such as nitrocellulose, ethyl cellulose or polyester. These binders can be used in the form of solution or dispersion in a solvent in the invention, and the binder can be varied depending upon the type of the solvent. Preferably, the water-soluble or dispersible binder can be used in the aqueous solution or dispersion. Of course, the metal compound of aromatic carboxylic acid can be coated without using the binder. It is to be noted that the binder is optional because it may not be necessary in the case where the solvent is organic in nature. The amount of binder used can be varied and more or less used depending on the kind thereof and the kind of other additives. However, it is preferably used at a level of from 5 - 30 parts by weight per 100 parts by weight on a solids basis of the total color developer layer composition.

Further, inorganic pigments such as clays, e.g., Japanese acid clay, activated clay, etc.; metal oxides and hydroxides, e.g., zinc oxide, magnesium oxide, magnesium carbonate, magnesium hydroxide, etc., can be present in order to improve the developing capability and increase the oil absorption ability.

The coating solution is then coated on a support such as paper, synthetic paper or film so that the amount of the metal compound of an aromatic carboxylic acid coated is more than 0.1 $g/m^2$, and preferably 0.3 - 2 $g/m^2$ of the support. Generally more than 10 $g/m^2$ is not required. The effect according to this invention is not lost outside of this range because the amount of the compound coated is determined mainly by economic considerations.

This invention relating to the recording sheet essentially lies in the color developer and any factors other than those specifically mentioned above, i.e., additives to the color developer, the kind and form of color former and the kind of solvent, etc., can be freely and easily selected by one of ordinary skill in the art.

According to this invention, not only is the color developing capability remarkably improved but also the preparation of the coating solution is simplified and the viscosity of prepared coating solution is low. This viscosity is not increased or is only increased to a slight extent with the passage of time. Therefore, the coatability is improved to a great extent with little formation of bubbles. Additionally, the important characteristics of a recording sheet, such as the light fastness, retention of activity with the passage of time and water resistance of the color former, are not affected adversely.

The recording sheet according to this invention is illustrated in greater detail by the following examples, to which this invention is not to be interpreted as being limited.

The effect according to this invention in the following examples was determined by the combination of a sheet, in which a support was coated with the color developer composition according to this invention, and a capsule sheet, in which microcapsules containing a color former were manufactured as described hereinafter and coated on a support.

While the microcapsules containing the color former can be manufactured using various known techniques, they were manufactured as follows according to the disclosure contained in U.S. Pat. No. 2,800,457.

All parts and percents are by weight unless otherwise indicated.

Ten parts of acid-treated pigskin gelatin and 10 parts of gum arabic were dissolved in 400 parts of water, 0.2 part of Turkey red oil was added as an emulsifier and 40 parts of an oil containing a color former were dispersed therein. The oil containing color former was a 2% solution of Crystal Violet Lactone or 3-N,N-diethylamino-7-dibenzylaminofluoran in an oil consisting of 4 parts of an alkylated naphthalene (isopropyl naphthalene) and 1 part of kerosene. When the oil drop size was 2 microns on an average, the emulsification was stopped. Water at 40° C was added thereto to make the entire amount 900 parts and the stirring was continued, during which time attention was payed such that the liquid temperature did not drop below 40° C. The pH-value of liquid was then adjusted by adding 10% acetic acid so that coacervation took place. The liquid was cooled with ice for 20 min. with further stirring to gel the coacervate film deposited around the oil drops. Seven parts of a 37% formalin were then added at a liquid temperature of 20° C. An 15% sodium hydroxy aqueous solution was added at 10° C to adjust the pH-value to 9. Successively, it was heated for 20 min. to a liquid temperature of 50° C.

The resulting microcapsule dispersion was adjusted to 30° C and coated on a paper of 40 g/m² in a coated amount of 6 g (solids)/m² and dried.

In each example, the color developing capability was determined by measuring the absorption maximum density using a Beckmann spectrophotometer (manufactured by Toshiba Co.) formed when a capsule sheet and a color developer sheet were contacted and color formed by applying a pressure of 600 kg/cm³.

EXAMPLE 1

Five grams of Japanese acid clay and 3 g of agalmatolite were dispersed in 30.6 ml of water. The pH of the resulting clay slurry was adjusted to 10 by adding 20% sodium hydroxide. To the slurry were added 0.1 g of sodium hexametaphosphate and 0.2 g of the sodium salt of a condensate (1:1 molar ratio; degree of condensation, 7) of naphthalene sulfonic acid and formaldehyde. 5 g of a 10% solution of gelatin or a gelatin derivative having the gell strength and isoelectric point shown in the table below were added with stirring. 0.7 g of zinc chloride dissolved in 10 ml of water was added gradually with stirring and 2.5 g of 3,5-di-tert-butyl salicylic acid and 0.4 g of sodium hydroxide dissolved in 30 ml of water were then added gradually. 5 g of styrene-butadiene copolymer (1:1 molar ratio) latex were added as a binder to obtain a coating solution. The coating solution was coated on a 50 g/m² paper using a coating rod so as to obtain a coated amount of 3 g (solids)/m² and dried.

CONTROL 1

Five grams of Japanese acid clay and 3g of agalmatolite were dispersed in 30 ml of water. The pH of the resulting clay slurry was adjusted to 10 by adding 20% sodium hydroxide. To the slurry were added 0.1 g of sodium hexametaphosphate and 0.2 g the sodium salt of condensate of naphthalene sulfonic acid and formaldehyde. 0.7 g of zinc chloride dissolved in 10 ml of water was added gradually with stirring and 2.5 g of 3,5-di-tert-butyl salicylic acid and 0.4 g of sodium hydroxide dissolved in 29.5 ml of water were then added gradually. 4 g of styrene-butadiene copolymer latex as described in Example 1 were added as binder to yield a coating solution. The coating solution was coated on a 50 g/m² paper using a coating rod so as to obtain a coated amount of 3 g(solid)/m² and dried.

Table 1

Results of Comparison Test

| No. | Kind | Kind and Physical Properties of Gelatin: Treatment | Jelly Strength (g) | Isoelectric Point | Viscosity of Coating Solution: Directly after Preparation (cp) | One day after Preparatin (cp) | Color Developing Capability for Crystal Violet Lactone |
|---|---|---|---|---|---|---|---|
| 1 | According to the present invention | Treatment with Acid | 148 | 8.2 | 33 | 76 | 0.912 |
| 2 | " | " | 105 | 8.2 | 35.2 | 70 | 0.935 |
| 3 | " | " | 56 | 7.7 | 41.2 | 12.7 | 0.967 |
| 4 | " | Treatment with | 148 | 5.0 | 36.9 | 70 | 0.866 |
| 5 | " | Treatment with Glue | 30 | 5.0 | 27.5 | 21.2 | 0.880 |
| 6 | " | " | 20 | 5.0 | 43.5 | 18.7 | 0.953 |
| 7 | " | Acetylated Gelatin (degree of 93%) | 220 | 4.33 | 24.7 | 88.0 | 0.888 |
| 8 | " | Phthalated Gelatin (degree of 45%) | 194 | 4.09 | 26.9 | 37.4 | 0.860 |
| 9 | " | " (degree of 97%) | 160 | 3.98 | 28.1 | 28.6 | 0.923 |
| 10 | " | Succinated Gelatin (degree of 90%) | 222 | 4.19 | 21.2 | 24.8 | 0.867 |
| 11 | " | Gelatin Modified with m-Carboxybenzene Sulfochloride (degree of 90%) | 170 | 4.05 | 29.5 | 31.2 | 0.875 |
| 12 | " | Gelatin Modified with m-Fluorosulfonyl Benzoic Acid (degree of 90%) | 165 | 3.92 | 30.1 | 32.5 | 0.886 |
| 13 | Control | — | — | — | 15.0 | 398.2 | 0.810 |

The jelly strength was determined according to the test method for photographic gelatin (The Joint Council for The Test Method for Photographic Gelatin). As can be seen from the results set forth in the above table, it was found that the lower the jelly strength was, the lower the aging viscosity was and the higher was the color developing capability.

EXAMPLE 2

Five grams of activated clay were dispersed in 27 ml of water. The pH of the resulting clay slurry was adjusted to 11 by adding 20% sodium hydroxide. A 15% gelatin solution having a jelly strength of 60 g and an isoelectric point of 7.9 was added in an amount as described in the table hereinafter with stirring. 2.0 g of 3,5-di-tert-butyl salicylic acid and 0.32 g of sodium hydroxide were dissolved in 25 ml of water and then added gradually with stirring. Further, 1.30 g of zinc sulfate were dissolved in 8 ml of water and then added gradually. A styrene-butadiene copolymer latex (48% solid) as described in Example 1 as a binder was added in an amount as described in the table hereinafter to yield a coating solution. The coating solution was coated on a 50 g/m² paper using a coating rod so as to obtain a coated amount of 3 g (solid)/m² and dried.

CONTROL 2

Five grams of activated clay were dispersed in 27 ml of water. The pH of the resulting clay slurry was adjusted to 11 by adding 20% sodium hydroxide. 2.0 g of 3,5-di-tert-butyl salicylic acid and 0.32 g of sodium hydroxide were dissolved in 25 ml of water and then added gradually with stirring. Further, 1.30 g of zinc sulfate were dissolved in 8 ml of water and then added gradually. 5g of styrene-butadiene copolymer latex (48 wt. % solid) as described in Example 1 as a binder were added to obtain a coating solution. The coating solution was coated on a 50 g/m² paper using a coating rod so as to obtain a coated amount of 3 g (solid)/m² and dried.

Table 2

Results of Comparison Test

| No. | Kind | Kind and Physical Properties of Gelatin of Gelatin: Treatment | Strength (g) | Isoelectric Point | Amount of Gelatin used (15wt %) (g) | Amount of Styrene-Butadiene Latex Used (g) | Viscosity of Coating Solution: Immidiately after Preparation | One Day after Preparation | Color Developing Capability for Crystal Violet Lactone |
|---|---|---|---|---|---|---|---|---|---|
| 14 | According to the present invention | Treatment of gelatin with acid | 60 | 7.9 | 1g | 4 | 44.2 | 61.6 | 0.923 |
| 15 | " | " | " | " | 3g | " | 39.8 | 15.9 | 0.961 |
| 16 | " | " | " | " | 6g | " | 38.7 | 14.8 | 0.980 |
| 17 | " | " | " | " | 9g | " | 34.8 | 12.5 | 0.965 |
| 18 | " | " | " | " | 12g | " | 24.3 | 12.0 | 0.881 |
| 19 | " | " | " | " | 15g | " | 17.3 | 11.0 | 0.810 |
| 20 | Control | — | — | — | — | " | 24.0 | 450.0 | 0.793 |

As is obvious from the results set forth in the above table, it was found that the viscosity was lowered as the amount of gelatin used was increased. When the amount of styrene-butadiene latex used as a binder was constant, the maximum color developing capability is obtained for ca. 1% of gelatin used. However, if the amount of styrene-butadiene copolymer latex used is decreased in comparison to the amount of gelatin used, the color developing capability is not lowered to as great an extent even though gelatin is used in a larger amount.

EXAMPLE 3

Instead of the 3,5-di-tert-butyl salicylic acid used in Example 1, 3-cyclohexyl salicylic acid was used and instead of the zinc chloride magnesium sulfate was used.

As in Example 1, the aging viscosity was low and the color developing capability was high giving use to good results.

EXAMPLE 4

Instead of the 3,5-di-tert-butyl salicylic acid used in Example 1, 3-phenyl salicylic acid was used and instead of the zinc chloride aluminum sulfate was used.

As in Example 1, the aging viscosity was low and the color developing capability was high giving use to good results.

While the invention has been described in detail and with reference to specific embodiments thereof, it will be apparent to one skilled in the art that various changes and modifications can be made therein without departing from the spirit and scope thereof.

What is claimed is:

1. The process for forming a recording sheet comprising a support having thereon a color developer layer containing (1) a metal compound of an aromatic carboxylic acid which is the reaction product of an alkali metal salt of an aromatic carboxylic acid and a water soluble metal salt wherein the metal is selected from the group consisting of a metal of Group 1B of the Periodic Table, a metal of Group IIA, a metal of Group IIB, a metal of Group IIIB, a metal of Group IVA, a metal of Group VIA, a metal of Group VIIB or a metal of Group VIII and (2) at least one of gelatin or a gelatin derivative formed by reacting gelatin with an aromatic or aliphatic compound, said metal compound of an aromatic carboxylic acid being capable of forming a colored image when reacted with a color former, which process comprises:

reacting said alkali metal salt of said aromatic carboxylic acid and said water-soluble metal salt in the presence of at least one of said gelatin or said gelatin derivative and thereafter coating the resulting product on said support to provide said recording sheet.

2. The process of claim 1, wherein said metal is copper, silver, magnesium, calcium, zinc, cadmium, mercury, aluminum, gallium, tin, lead, chromium, molybdenum, manganese, cobalt or nickel.

3. The process of claim 1, wherein said color developer layer contains a mixture of gelatin and a gelatin derivative.

4. The process of claim 1, wherein said metal compound of an aromatic carboxylic acid and at least one of said gelatin or said gelatin derivative is present in a binder.

5. The process of claim 1, wherein said gelatin and said gelatin derivative have a jelly strength of less than 150.

6. The process of claim 1 wherein said metal of said metal compound is selected from the group consisting of zinc, tin, aluminum and nickel.

7. The process of claim 1 wherein said metal is selected from the group consisting of magnesium and calcium.

8. The process of claim 1, wherein said aromatic carboxylic acid is represented by the formula:

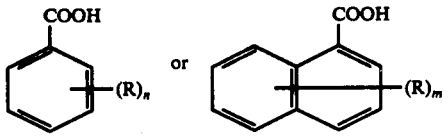

wherein R may be the same or different and represents a hydrogen atom, a hydroxy group, a halogen atom, a nitro group, an alkyl group having 1 to 10 carbon atoms, of which the total carbon atoms are less than 13, an aryl group, an arylamino group and an alicyclic group, *m* is an integer of 0 to 7 and *n* is an integer of 0 to 5, and the aromatic carboxylic acid may be dimerized through the substituent R as a methylene group.

9. The process of claim 8, wherein said aromatic carboxylic acid is represented by the formula:

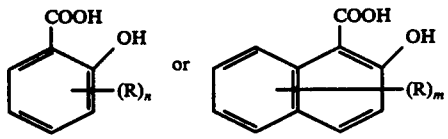

wherein R, *m* and *n* are as defined in claim 8.

10. The process of claim 8, wherein said aromatic carboxylic acid is represented by the formula:

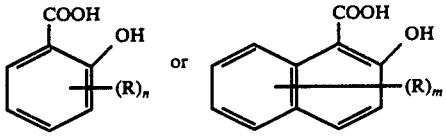

wherein R is as defined in claim 8, *n* is 1 or 2 and at least one R is in the meta-position relative to the hydroxy group.

11. The process of claim 8, wherein said gelatin or said gelatin derivative is used in an amount of from 10 to 100 parts by weight per 100 parts by weight of the aromatic carboxylic acid of said metal compound of an aromatic carboxylic acid.

12. The process of claim 11, wherein said gelatin derivative is the reaction product of gelatin with an acid anhydride or a compound having a reactive halogen atom.

13. The process of claim 12, wherein said acid anhydride is phthalic, benzoic, trimellitic, pyromellitic, sulfophthalic, maleic, succinic, or acetic acid anhydride.

14. The process of claim 12, wherein said compound having a reactive halogen atom is a sulfonylchloride group containing compound, a sulfonylfluoride group containing compound, an acyl chloride group containing compound, an acyl bromide containing compound, a compound having a free halogen atom, an isocyanate, or an N-allyl-N-vinylsulfonamide.

* * * * *